US006340409B1

(12) United States Patent
Shackford

(10) Patent No.: US 6,340,409 B1
(45) Date of Patent: Jan. 22, 2002

(54) METHOD FOR MULTISTAGE BLEACHING USING GASEOUS REAGENT IN THE FIRST STAGE WITH CONTROLLED GAS RELEASE

(76) Inventor: Lewis Donald Shackford, 8 Riverside Dr., Merrimack, NH (US) 03054

( * ) Notice: Subject to any disclaimer, the term of this patent is extended or adjusted under 35 U.S.C. 154(b) by 0 days.

(21) Appl. No.: 08/054,588

(22) Filed: Apr. 29, 1993

(51) Int. Cl.[7] ..... D21C 7/06; D21C 9/153

(52) U.S. Cl. ..... 162/52; 162/65; 162/246; 162/252

(58) Field of Search ..... 162/65, 65 B, 162/63, 52, 246, 252, 57

(56) References Cited

U.S. PATENT DOCUMENTS

| | | | | | |
|---|---|---|---|---|---|
| 3,754,417 | A | * | 8/1973 | Jamieson | 162/65 |
| 3,826,742 | A | | 7/1974 | Kirk et al. | 210/150 |
| 3,832,276 | A | * | 8/1974 | Roymoulik | 162/65 |
| 4,198,266 | A | * | 4/1980 | Kirk et al. | 162/29 |
| 5,034,095 | A | * | 7/1991 | Kido et al. | 162/17 |
| 5,116,475 | A | * | 5/1992 | Edlund et al. | 162/52 |
| 5,160,581 | A | | 11/1992 | Titmas | 162/61 |
| 5,389,201 | A | * | 2/1995 | Tsai | 162/57 |
| 5,411,633 | A | * | 5/1995 | Phillips et al. | 162/52 |

FOREIGN PATENT DOCUMENTS

EP 0397308 * 11/1990

OTHER PUBLICATIONS

Almberg, Lars, "Oxygen Delig . . . mill Systems", 1979, TAPPI Jun. 1979, vol. 62, No. 6, pp. 33–35.*

Kovasin, K., "Oxygen Delig . . . NSAQ Pulp", 1987, Journal of Pulp & Paper Science: vol. 13, No. 2, pp. J61–J66.*

John Lavigne., "Instrumentation Applications for Pulp & Paper Ind.", 1979, Miller Freeman Pub., pp. 100, 101, 158.*

Kaj Henricson, "New Generation Kraft Pulping & bleaching Technology", Paperi ja Puru, Apr. 1992.*

* cited by examiner

*Primary Examiner*—Dean T. Nguyen

(57) ABSTRACT

A pulp bleaching line has an initial stage using gaseous bleaching reagent followed by its subsequent stages without intervening washing or pumping steps. The pulp is transported from the initial stage through a mixer in which the pulp is heated and/or dosed with bleaching chemicals and through the subsequent stage by retained gas pressure developed in the initial stage. A portion of the retained gas may be separated and purged from the mixer through a pressure regulating device to optimize pressure for processes which follow the mixer/heater. This permits elimination of a washer and pump normally provided between the initial reactor and subsequent bleaching stage.

7 Claims, 4 Drawing Sheets

METHOD FOR MULTISTAGE BLEACHING USING GASEOUS REAGENT IN THE FIRST STAGE WITH CONTROLLED GAS RELEASE

BACKGROUND OF THE INVENTION

This invention relates generally to wood pulp bleaching processes and more particularly to wood pulp bleaching processes employing gaseous bleaching reagents.

Wood pulp bleaching with gaseous reagents, such as oxygen and ozone, promise significant reduction of objectionable pulp mill effluent to streams and other bodies of water. Elimination of chlorine compounds from the bleaching sequence promises great economic and ecological benefits. However, incorporation of these bleaching reagents can impose significant capital costs on the pulp mill.

For example, the incorporation of ozone has been hindered in commercial applications to a large extent by high capital costs which are inherent to common prior art bleaching sequences which usually require that an ozone bleaching stage is followed by a pulp washing step. From the washer, the pulp is pumped at medium consistency to a mixer wherein alkaline chemicals, such as caustic soda together with any one of a number of reinforcing agents, eg. oxygen, hydrogen peroxide, sodium hypochlorite, or the like are added to the pulp. At the same time, the pulp is heated to increase its temperature above that at which it was discharged from the ozone reactor. The heated and alkalized pulp is then discharged from the mixer to the alkaline extraction stage.

Addition of the cost of the washer and pump to the cost of an existing bleaching operation in order to incorporate an ozone bleaching stage, when considered together with other difficulties and costs associated with ozone bleaching, often makes ozone bleaching economically undesirable. Any reduction of capital equipment requirements clearly would improve the acceptance of ozone bleaching and would increase its use.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by a method for transporting pulp to subsequent bleaching stages from an initial gaseous bleaching stage for medium consistency pulp, including retaining gas pressure of the initial bleaching stage, discharging pulp from the initial bleaching stage under retained gas pressure, and allowing the retained gas pressure to transport the pulp to a mixer and onward through subsequent stages.

The foregoing and other aspects will become apparent from the following detailed description of the invention when considered in conjunction with the accompanying drawing figures.

DETAILED DESCRIPTION

Figure 1:
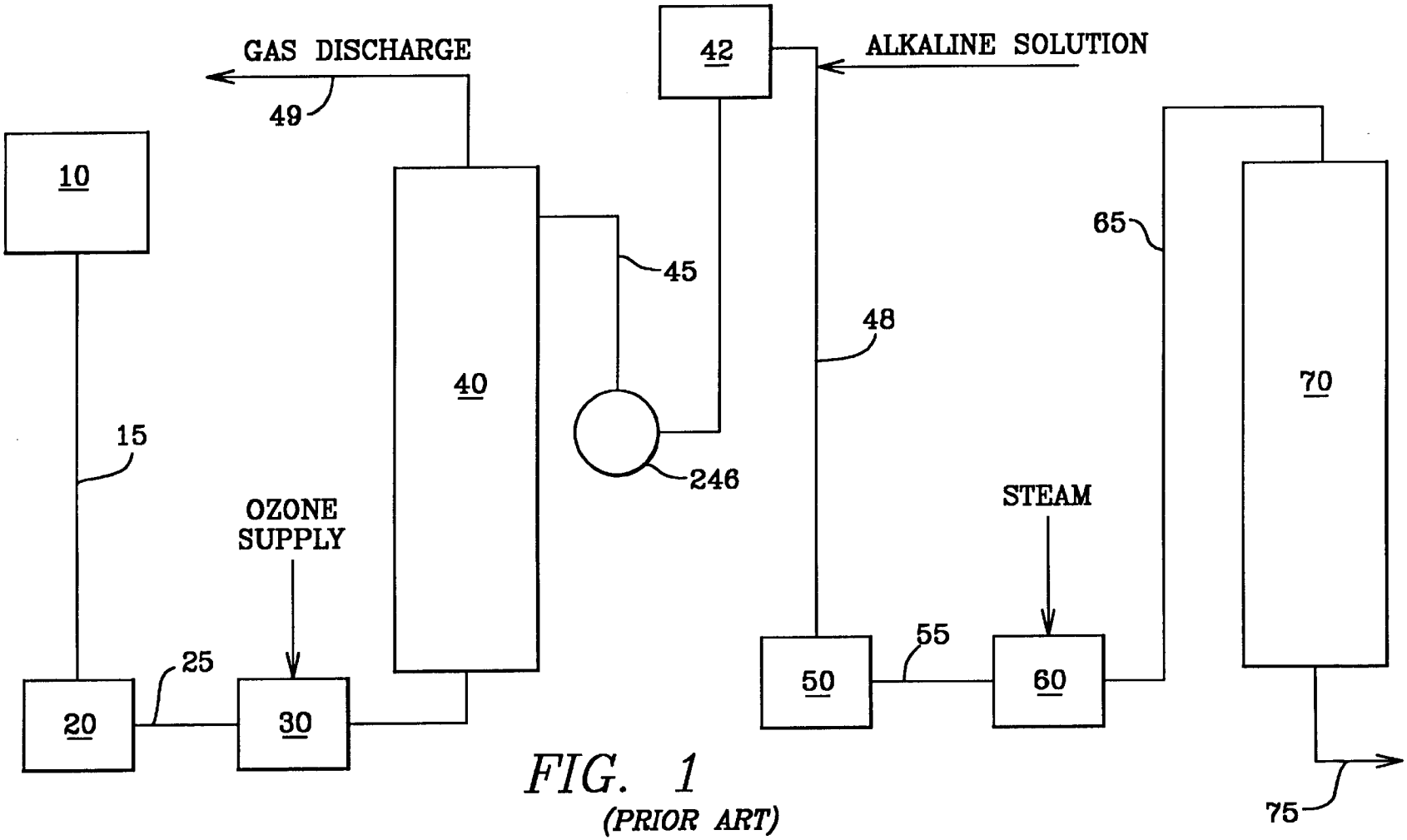
FIG. 1 (PRIOR ART)
FIG. 1 is a schematic view illustrating a gaseous bleaching stage in a portion of a pulp processing line of the prior art.

FIG. 1 shows a portion of a pulp processing line incorporating (as an example) an ozone bleaching stage of the prior art. The pulp is washed in washer 10 and discharged through conduit 15 to thick stock pump 20, from which it is pumped through conduit 25 to ozone mixer 30. Ozone from the ozone supply, together with its carrier gas, is added to the pulp in the mixer, and the mixture is fed through conduit 35 to ozone/pulp contactor 40.

After reaction with and finally separation from the pulp in contactor 40, the remaining ozone and its carrier gas, together with gaseous reaction products, are removed through conduit 49 for reprocessing or other disposition. The pulp is discharged through conduit 45 into washer 42 and from there into medium consistency pump 50 through conduit 48. It is then pumped through conduit 55 to mixer and heater 60, where its temperature is increased and alkaline chemicals are added.

The resulting heated mixture is fed through conduit 65 to alkaline extraction reactor 70. After a required reaction time, the pulp is discharged through conduit 75 to subsequent washing and other processing. It should be noted that discharge, from the contactor 40, of residual ozone, together with its carrier gas and gaseous reaction products, through conduit 49 results in a decrease of pressure in the system downstream of the pulp ozone contactor reactor 40. This necessitates addition of pump 246 to transport the pulp to the washer, and a pump 50 to transport the pulp beyond washer 42. If there is sufficient hydrostatic head, there should be no need for pump 246 prior to washer 42 in the sequence. Pump 50, provides the pressure necessary to transport the pulp, usually at medium consistency, to mixer 60 and on through the balance of the subsequent alkaline stage.

Figure 2:
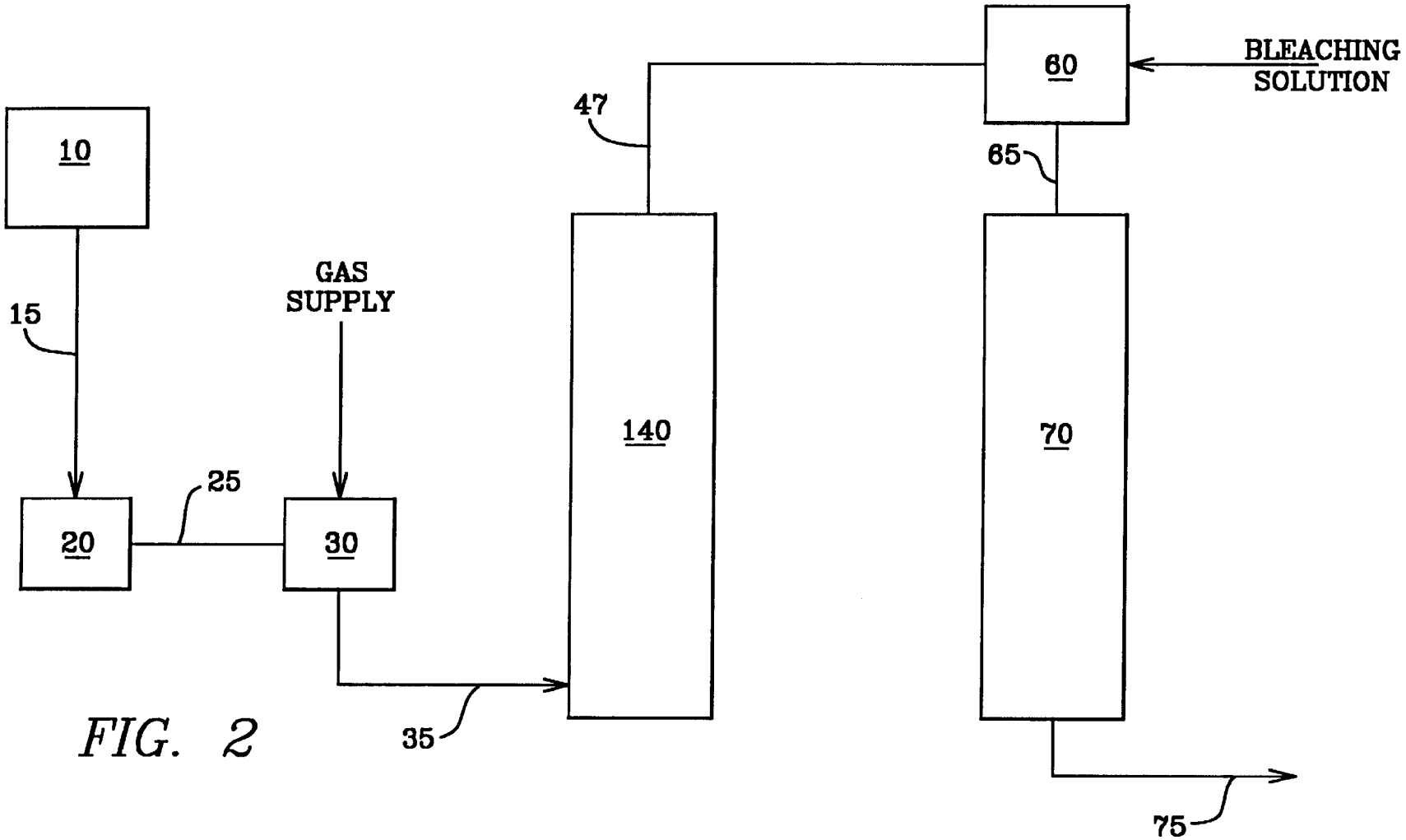
FIG. 2 is a schematic view illustrating a portion of a pulp processing line as in FIG. 1 this time incorporating the present invention.

Referring to FIG. 2, an embodiment of the present invention can be seen, as applied to ozone bleaching followed by an alkaline stage, in which washer 10, thick stock pump 20, and ozone mixer 30 and their connecting conduits 15, 25, and 35 are the same as in FIG. 1. However, ozone/pulp contactor 140 is somewhat different in that it has no conduit 49 through which to vent gases. Rather, the ozone and carrier gas which enter through conduit 35 must exit with the pulp and gaseous reaction products only through conduit 47. This limitation retains the gas pressure developed in the ozone bleaching stage and enables the retained gas pressure to transport the pulp from contactor 140, through conduit 47, into mixer 60 and onward to at least an immediately subsequent bleaching stage comprising the alkaline stage.

In mixer 60, the pulp temperature is increased by heating, and alkaline chemicals needed for the alkaline stage are added to the pulp. The resulting mixture is discharged from mixer 60, still under the retained gas pressure, through conduit 65 into alkaline reactor 70. Upon substantial completion of the alkaline reaction, the treated pulp, still under the retained gas pressure, is discharged through conduit 75 to subsequent processing.

Figure 3:
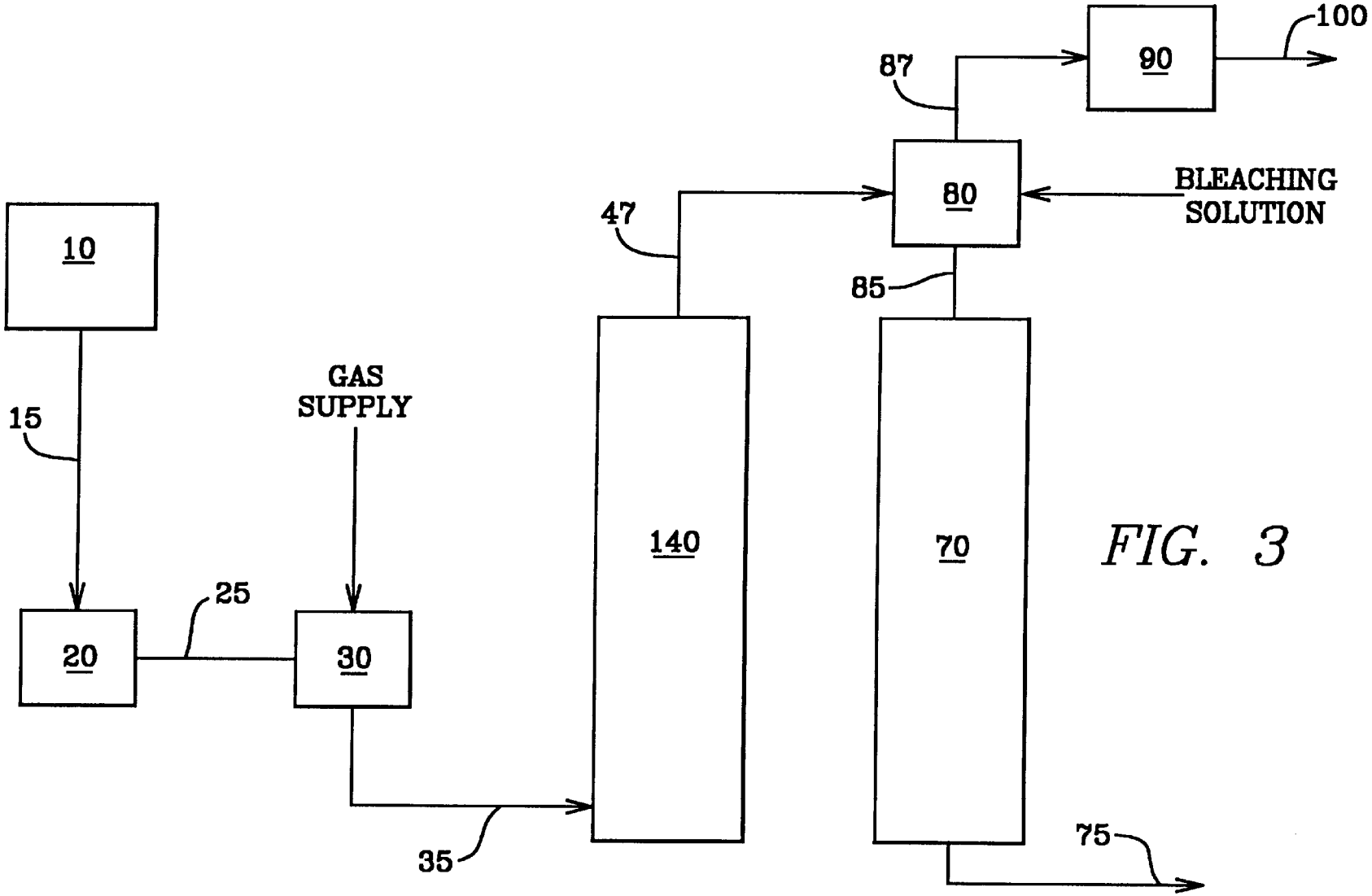
FIG. 3 is a view as in FIG. 2 illustrating another embodiment of the present invention.
Figure 4:
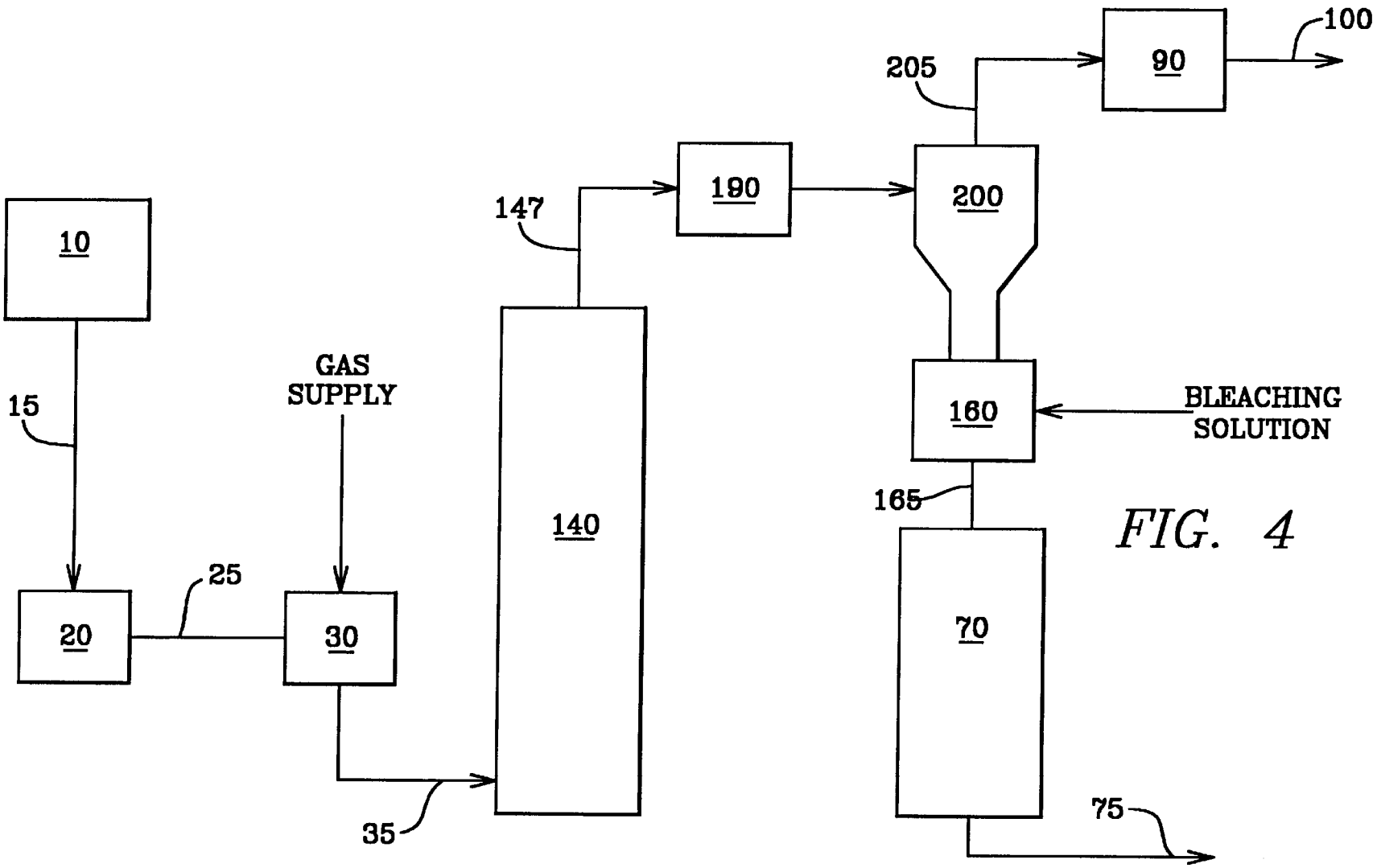
FIG. 4 presents another possible embodiment.

The embodiment of FIG. 3 is, in all respects except one, identical to that of FIG. 2. In this embodiment, mixer 80 is incorporated in place of the mixer (60) shown in FIG. 2. Mixer 80 has a gas discharge conduit 87 through which a portion of the retained gas pressure may be released through pressure regulating device 90. This purges a sufficient quantity of the retained gas to leave only sufficient pressure in the mixer for transport of the pulp to or to and through alkaline reactor 70. FIG. 4 illustrates yet another embodiment of the invention which provides relatively fine pressure tuning capability for the bleaching system.

By incorporating gas separator 200, the quantity of gas purged can be more accurately controlled. The prior art system of FIG. 1 has gas separation in the ozone/pulp contactor 40 as a consequence of its operating characteristics, and substantially all of the residual gas is removed. The embodiment of FIG. 3 takes advantage of the gas separation which tends to occur naturally in a gas/liquid system. This allows a portion of the gas pressure to be purged, as already described, but such purging is limited so that a desirable quantity of gas carries forward with the pulp to the subsequent bleaching stage.

In most cases, even though FIGS. 1–4 show either upflow or downflow through the vessels, flow may be in either direction according to conduit arrangements which are determined by desired operating conditions. Clearly, downflow of the pulp is aided by gravity, while upflow requires a driving pressure to overcome gravity. Accordingly, the pressure regulation of the present invention provides a degree of versatility which is not normally available without the use of pumps.

It is also clear that, due to the thermal balance in the system, it may be desirable to have an additional mixer to heat the pulp (usually using steam).

In the scheme of FIG. 4, a pressure reduction device 190 is interposed between ozone/pulp contactor 140 and gas separator 200. The pulp from the gas separator flows into mixer 160 in which the temperature is increased by heating and alkaline chemicals are blended with the pulp as required by the alkaline stage.

The blended and heated pulp is discharged through conduit 165 to alkaline vessel 70. After the reaction is finished, the pulp is discharged to subsequent processing through conduit 75.

Gas from gas separator 200 is routed through conduit 205 to pressure regulator 90 and exhausted for reprocessing or other appropriate disposal through conduit 100. The gas in gas separator 200 acts as a pneumatic spring whose stiffness is determined by the backpressure imposed by pressure regulator 90. This maintains a relatively constant driving force for the pulp through mixer 160 and alkaline vessel 70.

Of course, depending on the configurations of the vessels of the system, either upflow or downflow of the pulp may be desirable for given operating conditions. This will dictate the degree of pressure regulation required and will determine whether the embodiment of FIG. 2, with no pressure regulation, FIG. 3, with limited pressure regulation, or FIG. 4 with full pressure regulation, is the preferred embodiment, recognizing that each embodiment results in specific quantities of gas carried forward to subsequent bleaching stages.

Liebergott, et.al (1992 Non-Chlorine Bleaching Conference) showed that there may be a beneficial effect in delignification efficiency by eliminating the washing step between an ozone bleaching stage and an alkaline extraction stage. Of course, elimination of the washing step will require additional alkali to be used due to carry forward of acid from the first stage, but this is partially offset by savings in capital equipment costs. The result of this invention is to eliminate additional equipment to further reduce the capital cost of the project, and provide for oxygen gas to be carried forward into the subsequent stage or stages which has a further beneficial effect in delignification efficiency. This process is applicable to all systems employing bleaching agents in which the subsequent stage is enhanced by the presence of oxygen gas or is at least not affected in a negative manner. This is very desirable since the cost of purchasing and maintaining pumps which transport pulp at medium consistency is quite high and represents a financial burden on mill operations.

According to this invention, the second stage may be any alkaline stage whose performance is enhanced by exposing the pulp and reactants to oxygen gas, i.e., sodium hydroxide (E) alone or with hydrogen peroxide (P), or sodium hypolchlorite (H). In this example the performance of the stage is enhanced, or reinforced by oxygen. The conventional designations of these enhanced stages then are $E_O$, $E_{OP}$, or $E_{OH}$ . It is understood that additional bleaching reagents which operate in an acid environment in the subsequent stage of bleaching may become commercially viable in the future, so this invention is not limited to that in which the first stage is acid and the second stage is alkaline. Therefore, according to this invention, the two or more stages of bleaching in which the motive force for transporting pulp through the subsequent stages is the gas pressure of the first stage, may be any combination of acid or alkaline stages.

By the methods of the invention described herein, it is possible to eliminate a pulp washer and a pulp transfer pump from a pulp processing line, thereby substantially reducing the cost of the pulp processing system.

What is claimed is:

1. A method for transporting pulp from an initial gaseous bleaching stage to subsequent bleaching stages, comprising the steps of:

supplying a medium consistency pulp to a pulp contactor apparatus included in the initial gaseous bleaching stage which comprises an ozone bleaching stage;

delivering to the pulp contactor apparatus a gaseous bleaching reagent at a predetermined pressure;

maintaining the pressure of the gaseous bleaching reagent within the pulp contactor apparatus;

discharging the medium consistency pulp from the pulp contactor apparatus under said gas pressure;

using the gas pressure maintained by the pulp contactor apparatus as the motive force to transport the medium consistency pulp and the gaseous bleaching reagent to at least an immediately subsequent bleaching stage;

disposing a mixer between the initial gaseous bleaching stage and the immediately subsequent bleaching stage; and releasing a portion of the gas pressure from said mixer to reduce the quantity of the gaseous bleaching reagent carried forward to the immediately subsequent bleaching stage.

2. The method of claim 1, comprising the further step of:

providing a gas separator between said initial gaseous bleaching stage and said mixer to improve sensitivity of gas pressure adjustment by closely controlling purging of gas and thus the quantity of gas carried forward to said immediately subsequent stage.

3. The method of claim 2, comprising the further step of:

providing a pressure regulator through which said portion of gas pressure is released and which regulates gas pressure within said gas separator.

4. The method of claim 3, further comprising the step of:

interposing a pressure reduction device between the pulp contactor apparatus and the gas separator.

5. The method of claim 1, comprising the further step of:

providing a pressure regulator through which said portion of gas pressure is released.

6. In a portion of a wood pulp processing operating in which an ozone bleaching stage is followed by a mixer, in which alkaline chemicals are added, and an alkaline stage, the improvement in combination with said operation, comprising:

discharging a medium consistency pulp from said ozone bleaching stage under gas pressure developed for said ozone bleaching stage and allowing said pressure to transport said medium consistency pulp and said gas to a mixer for adding alkaline chemicals to and for heating said medium consistency pulp;

separating a portion of the gas and discharging said portion from said mixture of gas, medium consistency pulp and alkaline chemicals through a pressure regulating device; and discharging the alkali treated, medium consistency pulp and a second portion of the gas from the mixer to an immediately subsequent bleaching stage comprising the alkaline stage under a residual gas pressure determined by said pressure regulating device.

7. A method for processing pulp and transporting the pulp from an initial gaseous bleaching stage to subsequent bleaching stages, comprising the steps of:

supplying a medium consistency pulp to a pulp contactor included in said initial gaseous bleaching stage which comprises an ozone bleaching stage;

delivering to the pulp contactor a gaseous bleaching reagent at a predetermined pressure;

discharging the medium consistency pulp and the gaseous bleaching reagent from the pulp contactor;

adding a second bleaching reagent to the medium consistency pulp and the gaseous bleaching reagent wherein the second bleaching reagent is not the same as the gaseous bleaching reagent; and using the gas pressure maintained by the pulp contactor as the motive force to transport the medium consistency pulp, the gaseous bleaching reagent and the second bleaching reagent to a vessel included in an immediately subsequent bleaching stage.

* * * * *